US012535255B2

(12) United States Patent
Mouchet

(10) Patent No.: US 12,535,255 B2
(45) Date of Patent: Jan. 27, 2026

(54) CONTAINER FOR PHASE-CHANGE MATERIAL

(71) Applicant: SUN-ICE ENERGY PTE. LTD., Singapore (SG)

(72) Inventor: Jacques Mouchet, Les Clayes-sous-Bois (FR)

(73) Assignee: SUN-ICE ENERGY PTE. LTD., Singapore (SG)

( * ) Notice: Subject to any disclaimer, the term of this patent is extended or adjusted under 35 U.S.C. 154(b) by 119 days.

(21) Appl. No.: 18/562,289

(22) PCT Filed: May 20, 2022

(86) PCT No.: PCT/IB2022/054737
§ 371 (c)(1),
(2) Date: Nov. 18, 2023

(87) PCT Pub. No.: WO2022/243965
PCT Pub. Date: Nov. 24, 2022

(65) Prior Publication Data

US 2024/0159443 A1 May 16, 2024

(30) Foreign Application Priority Data

May 20, 2021 (FR) ..... FR2105277

(51) Int. Cl.
*F25D 3/00* (2006.01)
*A63C 19/10* (2006.01)

(52) U.S. Cl.
CPC ..... *F25D 3/005* (2013.01); *A63C 19/10* (2013.01); *F25D 2303/08222* (2013.01)

(58) Field of Classification Search
CPC ..... A63C 19/10; F25D 3/005; F25D 2303/08222; F25D 2303/08; Y02E 60/14; F28D 20/021; F24H 7/02
See application file for complete search history.

(56) References Cited

U.S. PATENT DOCUMENTS 4,211,208 A * 7/1980 Lindner ..... F28D 20/02 126/400
4,579,170 A 4/1986 Moses et al.

FOREIGN PATENT DOCUMENTS

| | | | | |
|---|---|---|---|---|
| CN | 103837030 A | | 6/2014 | |
| DE | 3332823 A1 | | 3/1985 | |
| DE | 102004035017 A1 | | 2/2006 | |
| GB | 2130700 A | * | 6/1984 | ..... F25D 3/00 |
| GB | 2489011 A | * | 9/2012 | ..... F24D 11/003 |
| KR | 101429165 B1 | | 8/2014 | |
| WO | WO-2006008276 A1 | * | 1/2006 | ..... F25B 39/02 |

OTHER PUBLICATIONS

International Search Report and Written Opinion in International Application No. PCT/IB2022/054737, mailed on Sep. 15, 2022.

* cited by examiner

*Primary Examiner* — Frantz F Jules
*Assistant Examiner* — Martha Tadesse
(74) *Attorney, Agent, or Firm* — Cognition IP, P.C.; Edward Steakley

(57) ABSTRACT

The present disclosure relates to a container (100) for a phase change material, wherein said container is characterized in that it comprises:

a closed shell (101) where a filling opening (103) is arranged;

a phase change material nested in said shell (101);

one or several recesses (105) designed to receive a conduit for refrigerant fluid.

19 Claims, 7 Drawing Sheets

[Fig. 1]
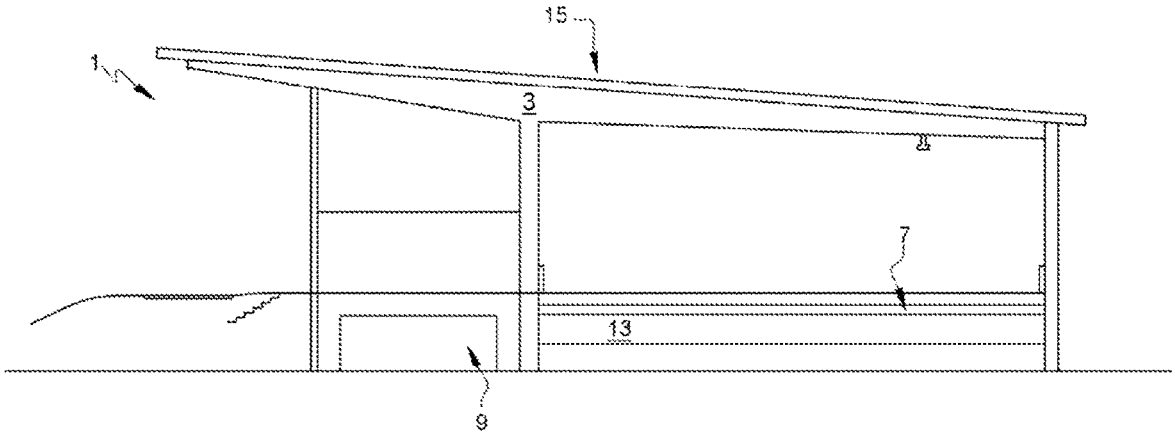
[Fig. 2]
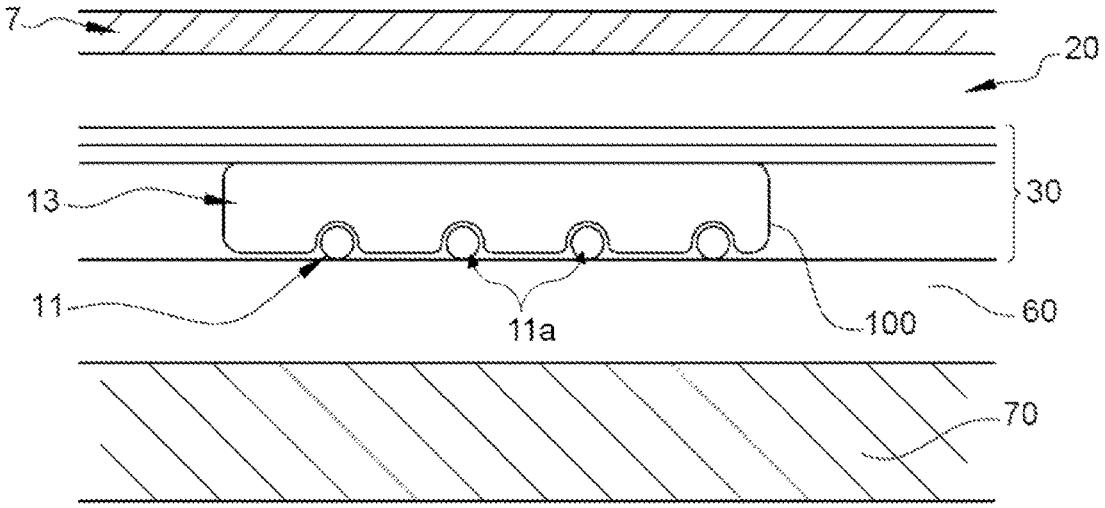

[Fig. 3]
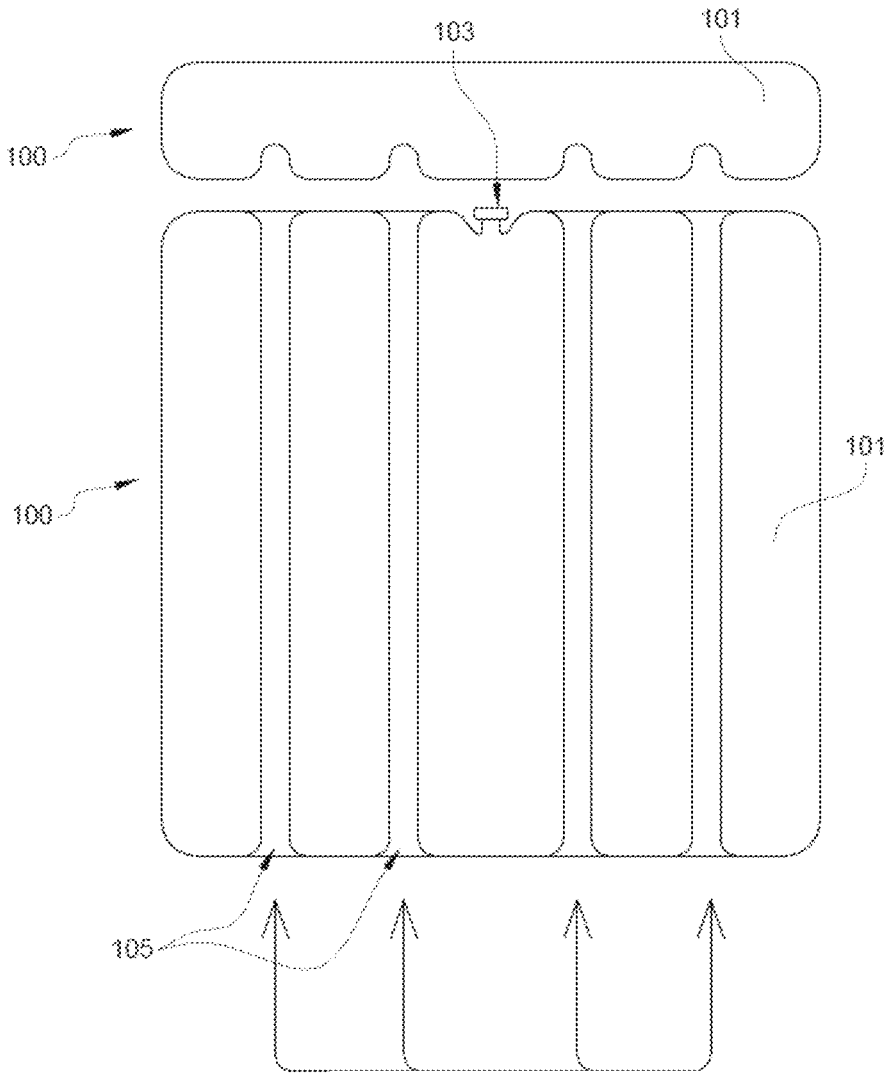

[Fig. 4]
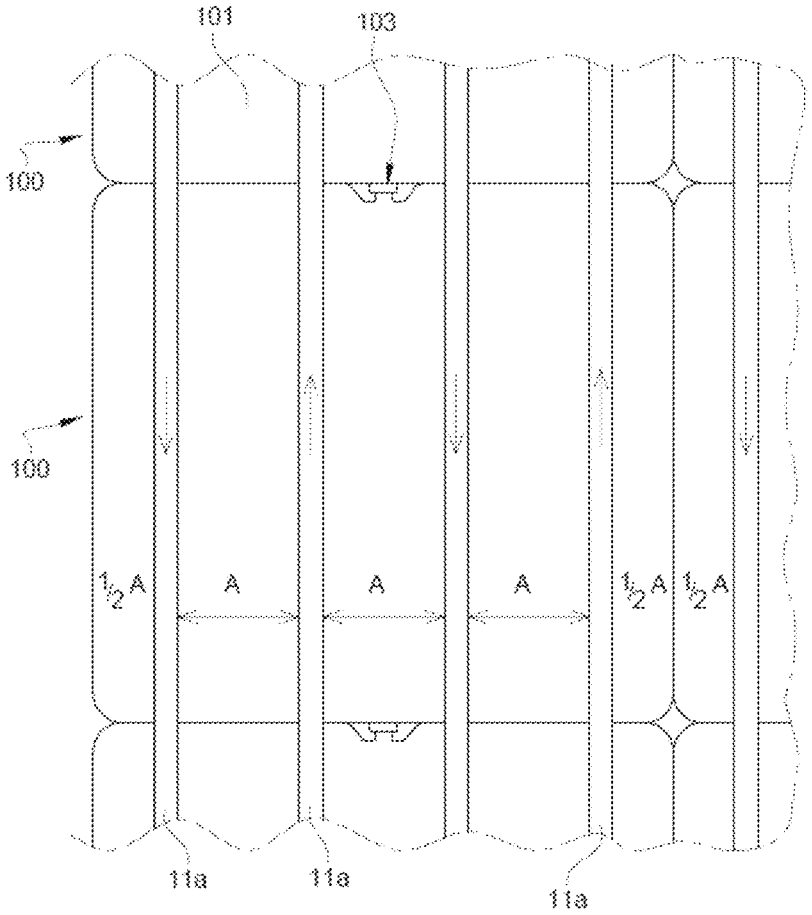
[Fig. 5]
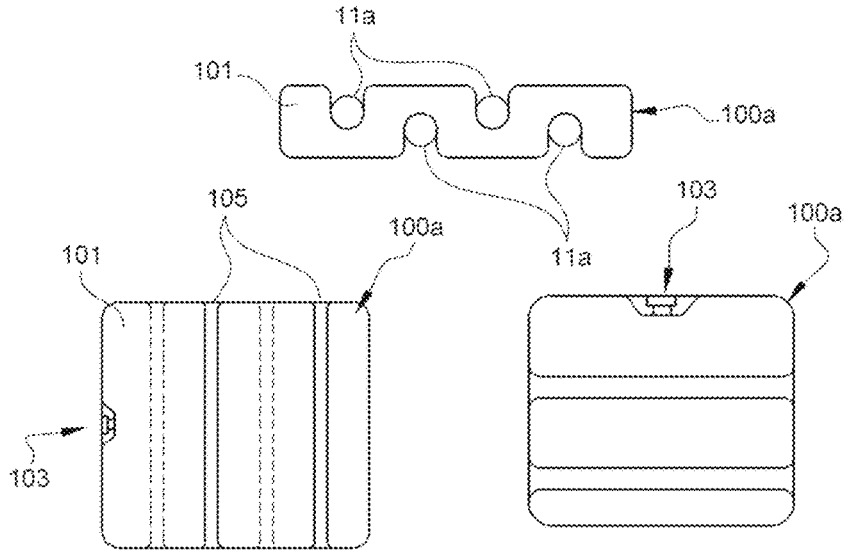

[Fig. 6]
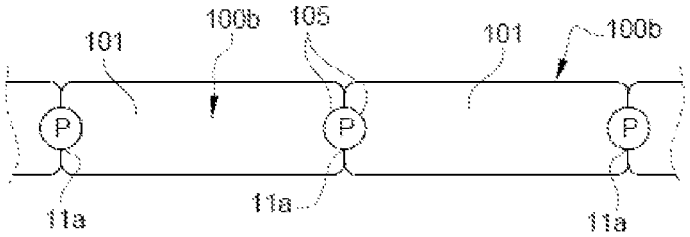
[Fig. 7]
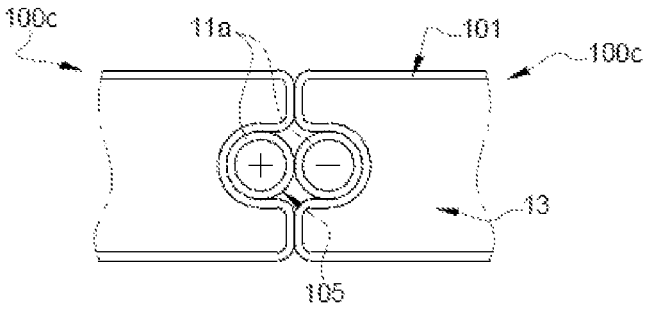
[Fig. 8]
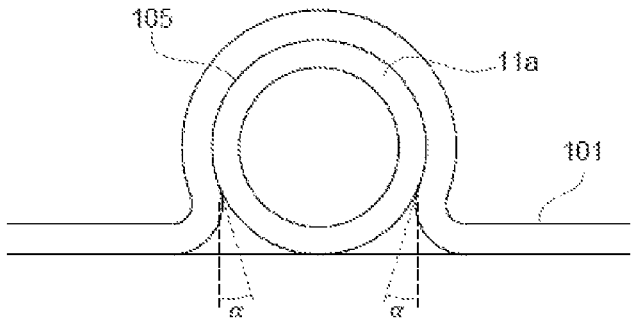

[Fig. 9]
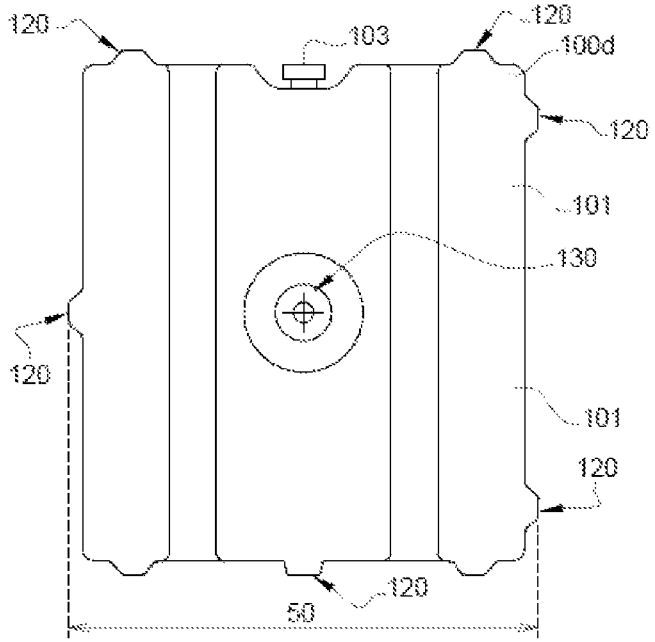
[Fig. 10]
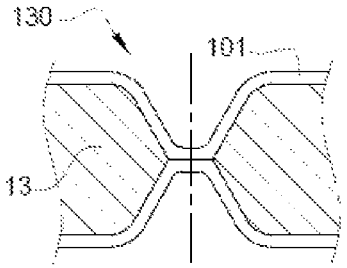

[Fig. 11]
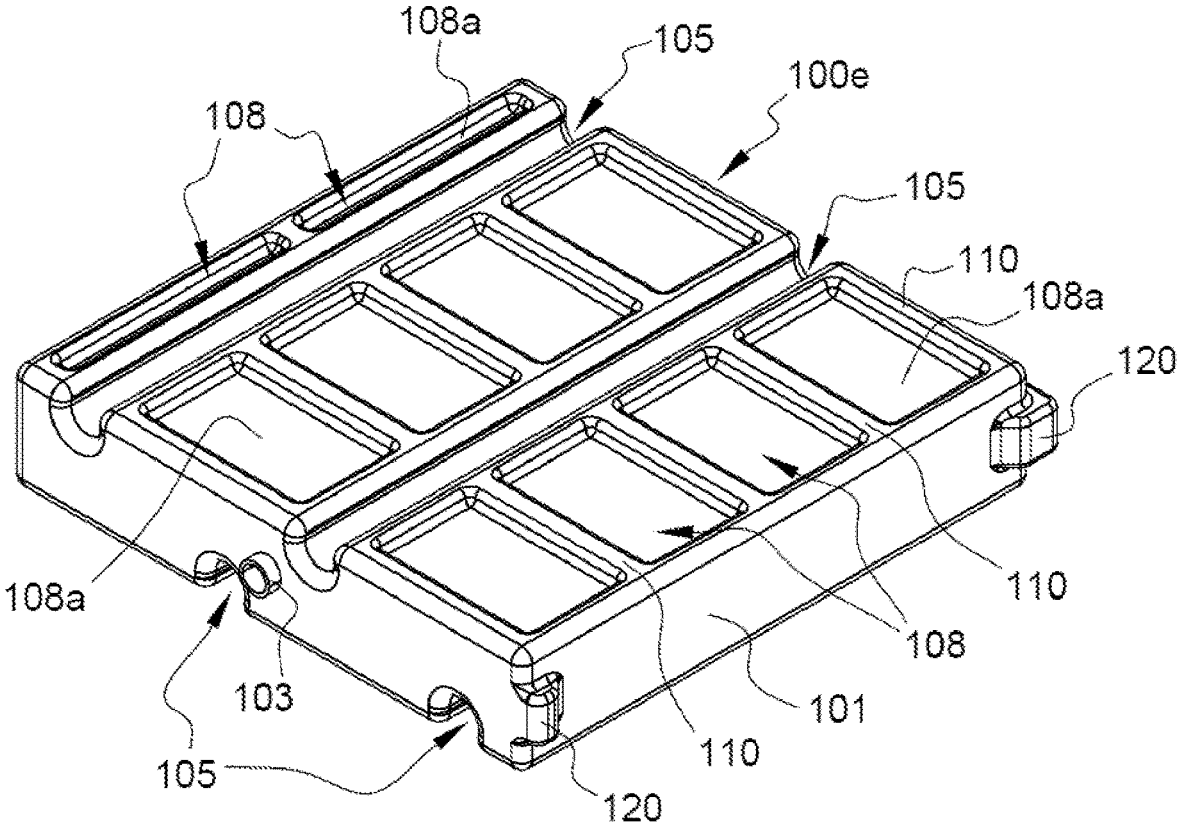

[Fig. 12]
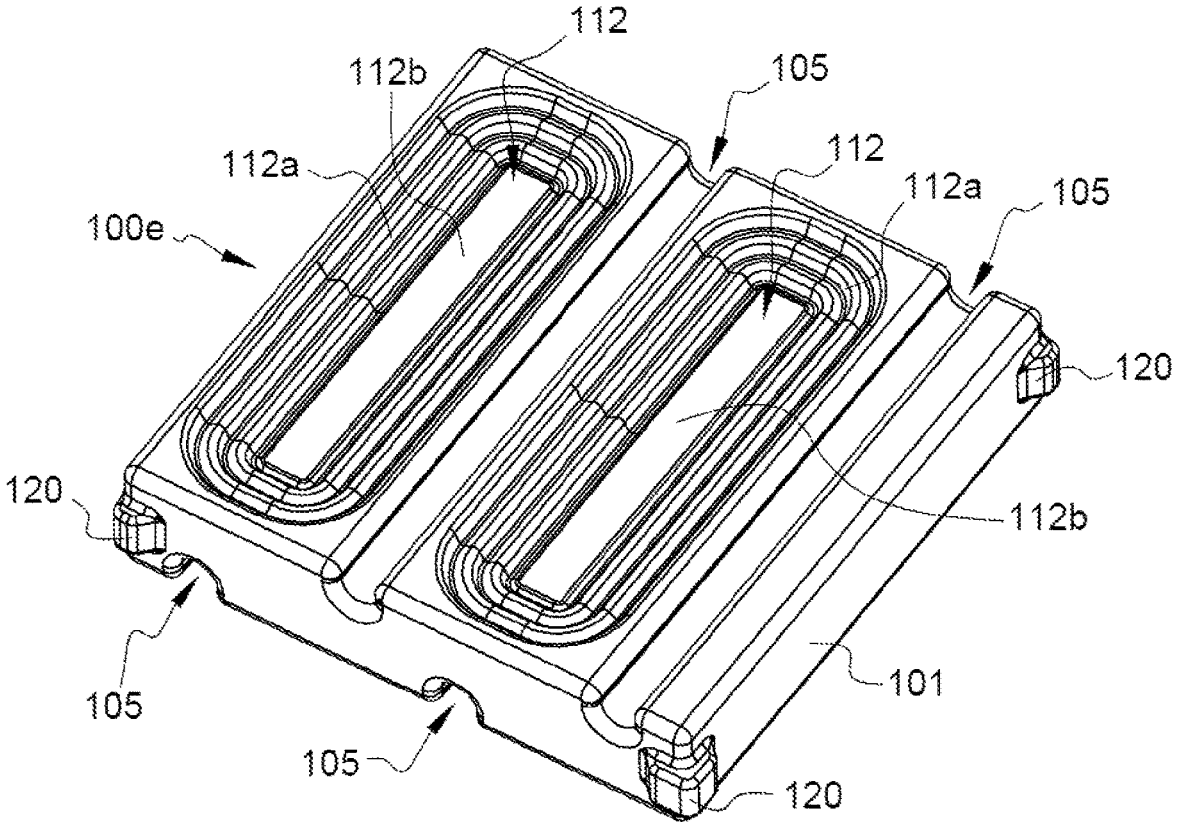

CONTAINER FOR PHASE-CHANGE MATERIAL

CROSS-REFERENCE TO RELATED APPLICATIONS

This application is a 35 U.S.C. § 371 U.S. National Stage application of International Application No. PCT/IB2022/054737, filed on May 20, 2022, which claims the benefit of priority of French Application No. FR2105277, filed on May 20, 2021, which are incorporated herein by reference in their entirety.

The present disclosure relates to the field of containers for phase change materials and of their use to manufacture refrigerated enclosures, volumes and/or surfaces.

The present disclosure also relates to refrigerated surfaces made of several containers according to the invention. Said refrigerated surfaces made of said containers are advantageously used to create floors, walls, partitions, etc. for example in artificial skating rink, cold rooms . . . .

As a reminder, an artificial skating rink is constituted of a closed building, such as a tent or a dome built on a slab designed to be covered with ice. Thus, said slab covered with ice (which means frozen water) makes it possible to do any kind of skating, curling, ice hockey, etc.

Several types of artificial skating rinks comprising tiles made of various materials, including refrigeration devices to cool enough water spilt on the tile to turn it to ice.

In some known achievements, the tiles are mounted on a layer that incorporates conduits for circulation of a refrigerant fluid set as a network and connected to a cooling unit that circulates the refrigerant fluid through said circuits.

In order to limit the unavoidable losses of cold from the cooling units, it is known to thermally isolate the tile by providing, between said tile and the primary ground, a layer of thermal isolating material, since its absence leads to too much loss. In some cases, it is known to have hot water circulate under this isolating layer to prevent the primary ground from freezing.

However, in spite of these measures, the artificial skating rinks known in the state of the art are characterized by important heat losses that require the constant functioning of powerful cooling units night and day, hence costly. In addition, it is hard to maintain the ice in good condition, since its upper surface is in contact with ambient, often wet air of the skating rink, because of the presence of skaters who may warm up the surface when moving along, and of the audience that warms up the ambient air.

Moreover, ice skating and its derivatives (hockey, figure skating, etc.) is more and more appreciated around the world, and more and more skating rinks re built around the world, in particular in some Asiatic countries.

Unfortunately, as previously mentioned, a skating rink requires much permanent energy to maintain much water as ice, so that people can skate on it.

This constraint is all the heavier in countries with hot and/or tropical climates, where the outdoor temperature are usually higher than 20° C. and rarely less than 0° C.

Think as well about the cold rooms that require much energy to refrigerate volumes, where perishable goods are stored at low temperature. Thus, similarly, these drawbacks and problems for skating rinks also apply to cold rooms. This is all the more important in the case of cold rooms than the foodstuff inside is fragile and may get lost if the temperature is not maintained stable over time.

The present disclosure can also be used for the thermal management of data centers, for example by using phase change materials with higher melting temperatures.

One of the purposes of the present disclosure is notably to propose an economical storage means to store phase change materials and make their integration easier into slabs, walls or ceilings, in particular to build skating rinks or cold rooms and for their transport or handling. On one hand, in skating rinks, the invention also makes it possible to maintain the quality of the ice of the skating surface and, on the other hand, to optimize the conservation of perishable goods that are stored inside. All that while limiting the power consumption of these installations.

Said invention can thus be presented as a container for phase change materials, comprising:

- a closed shell where a filling opening is arranged;
- a phase change material nested in said shell;
- one or several recesses designed to receive a conduit for refrigerant fluid.

The at least one recess in the shell allow a contact between the conduits of refrigerant fluid and the shell of the container, which optimizes the thermal transfers between the phase change material in the shell and the refrigerant fluid that circulates through said conduits.

The refrigerant fluid through said conduits is that of a secondary system that transfers frigories to the phase change material inside the containers.

In addition, it should be noted that said fluid of the secondary system does not change of phase in the working conditions of the invention and can be cooled by the fluid of a primary refrigerant system, considering that the fluid of the primary system is designed to change of phase.

The thermal exchanges between the different fluids of the primary and secondary systems are made through a dedicated heat exchanger (generally called «chiller»). It should be noted that a phase change material (PCM) is any material capable to change of physical state within a restricted range of temperature, for example around −15° C.

It should be noted that a refrigerant fluid is a fluid that allows the implementation of a thermodynamic cycle. It can be pure or a mix of pure fluids as a liquid phase, a gas phase or a mix of both according to the temperature and the pressure thereof. The fluid absorbs heat at low temperature and low pressure, then releases heat at higher temperature and pressure, for example during a change of physical state.

According to a possible feature, said shell where the phase change material is located comprises a «gas blanket» that makes it possible to manage without any notable warping the change of volume consecutive to the phase change of said material.

It is also possible to add an exhaust valve in the upper part of the container (which is notably connected to the gas blanket of said shell). Said exhaust valve comprises a vent that is, for example, connected through a conduit to the valves of other containers (this creates a network of the valves of said containers at their respective vents).

This system of vents, whether networked or not, is particularly useful to limit the rise of pressure of the gas blanket at the first solidification of the phase change material inside the shell of the container.

It is advantageous too to use a calibrated valve at the exhaust and intake to restrict the «breathing» (i.e. the gas exchanges between the inside and the outside of the shell) of the container in normal mode when there is little change of volume of the phase change material in the shell.

According to another possible feature, the phase change material has a melting temperature between −5° C. and −25° C., preferably between −10° C. and −20° C.

According to another possible feature, said refrigerant fluid contains glycol (pure or diluted) or any other suitable refrigerant fluid such as salted water, ammonia, etc.

Indeed, the used refrigerant fluid must not freeze at a temperature less or equal to the melting temperature of the phase change material.

According to another possible feature, said recesses are directly shaped in the shell of said container.

Directly shaped in the shell means that the shell was shaped to create one or several recesses designed to receive one or several refrigerant fluid conduits.

According to another possible feature, said shell is made of a plastic, a polymer or a metal.

According to another possible feature, said container has substantially the shape of a plate, a tile or a brick.

The container according to the invention can has different shapes adapted according to its purpose, as a tile or a plate for assembly as a floor or a ceiling, as a brick for assembly as a wall or a partition.

According to another possible feature, said container has a main extension plane.

Main extension plane refers to the fact that the container has two extension dimensions (or directions) very large relatively to the third one.

According to another possible feature, said recesses are grooves in the surface of said container.

Said grooves can be manufactured onto the main faces (or opposite faces to the main extension plane) an/or onto the lateral sides of the container.

According to another possible feature, said grooves are regularly spaced on said container.

It is important that the thermal transfers between the phase change material and the refrigerant fluid are as homogenous as possible.

According to another possible feature, said grooves are positioned, for example alternatively, on opposite faces of said container.

According to another possible feature, said one or several reception recesses have a retention angle.

The retention angle notably improves the contact between the fluid conduit and the shell, while making it possible to fit and maintain the conduit into its recess.

According to another possible feature, the container according to the invention has an embossed aspect on at least one of its faces.

In other words, according to a possible feature, the container has an alternating pattern of protrusions and recesses on at least one of its faces.

According to another possible feature, the container comprises, on at least one of its faces, deformable structures that are designed to warp under the effect of a change of state of the phase change material.

According to a feature of an embodiment, the container has a preset maximum volume that corresponds to a maximum bulk of the container. Preferably, the deformable structures are designed to warp under the effect of a change of state of the phase change material, so that the container has an instantaneous volume variable in time according to the warps of the deformable structures, wherein the instantaneous volume is not more than the maximum preset volume that corresponds to the maximum bulk of said container.

In other words, the deformable structures are able to warp and change the «instantaneous» volume of the container under the effect of a change of state of the phase change material, wherein the maximum volume of the container is invariable and a maximum limit for the instantaneous volume of the container.

It should be noted that instantaneous volume is the volume of the container at a given moment.

According to another possible feature, deformable structures comprise at least one bellow and/or a low density foam.

According to another possible feature, the deformable structures comprise at least one plane surface recessed from the terminal surface of the container, wherein said at least one bellow is designed to allow the movement of the plane surface toward the terminal surface until a limit that corresponds to the terminal surface of said container.

In other words, the plane surface can move to the terminal surface without protrude from the terminal surface of said container.

The present invention also relates to a refrigerated surface, characterized in hat it comprises an assembly of containers as described above.

The present invention also relates to a skating rink and a cold room comprising containers as described above.

The invention shall be better understood, and other goals, details, features and advantages shall appear more clearly in the following description of specific embodiments of the invention, which are introduced only for information and non-restrictively, with reference to the appended picture, where:

FIG. 1, referenced as [FIG. 1], is a very schematic cross-sectional view of a skating rink according to the invention;

FIG. 2, referenced as [FIG. 2], is a schematic cross-sectional view of a first embodiment, called direct mode, of the skating rink slab of FIG. 1;

FIG. 3, referenced as [FIG. 3], is a lateral schematic view from below of a container according to a first embodiment of the invention;

FIG. 4, referenced as [FIG. 4], is an assembly of several containers of FIG. 3 to create a refrigerated surface;

FIG. 5, referenced as [FIG. 5], is a front schematic view and from different sides of a container according to a second embodiment of the invention;

FIG. 6, referenced as [FIG. 6], is a lateral schematic view of a container according to a third embodiment of the invention;

FIG. 7, referenced as [FIG. 7], is a front and lateral schematic view of a container according to a fourth embodiment of the invention;

FIG. 8, referenced as [FIG. 8], is a front and lateral schematic view of a container according to a variant of embodiment of the invention;

FIG. 9, referenced as [FIG. 9], is a front schematic view of a container according to a variant of embodiment of the invention;

FIG. 10, referenced as [FIG. 10], is an enlarged detail view of an embodiment of the container of FIG. 9;

FIG. 11, referenced as [FIG. 11], is a perspective schematic view from above of a container according to a fifth embodiment of the invention;

FIG. 12, referenced as [FIG. 12] is a view from below of the container of [FIG. 11].

The [FIG. 1] is then a schematic cross-sectional view of a skating rink 1 according to the invention.

Said skating rink 1 is an artificial covered skating rink comprising a closed building 3 and a slab designed to be covered with ice 7. Said skating rink 1 notably comprises:

a refrigeration device 9 connected to a refrigerating network 11 though which a refrigerating fluid flows, such as glycol or glycoled water;

a phase change material 13 linked to said refrigeration device 9 through said refrigerating network 11.

Said phase change material 13 is notably designed to maintain the ice on the slab at a temperature less than the melting temperature of the ice, typically ca. 0° C. To do so, said phase change material 13 has a melting temperature between −5° C. and −25° C., preferably between −10° C. and −20° C.

Said skating rink 1 advantageously comprises photovoltaic panels 15 (or solar panels) and a battery to store electrical energy. Said photovoltaic panels 15 are located on the roof of the building 3 of the skating rink 1 or are integrated in a solar roof.

For example, the refrigeration device 9 is a set of heat exchangers, pump(s), compressor(s) and conduits 11 a of the cooling network 11 that allows to perform a thermodynamic cycle (such as a Carnot cycle, a Rankine cycle, etc.), where there is an exchange of calories between the inside and the outside of the skating rink 1. The pump and the compressor of said refrigeration device 9 notably circulates the refrigerant fluid through said heat exchangers and the conduits 11*a*.

More specifically, the refrigeration device 9 is designed to evacuate calories outward so that the refrigerant fluid best captures the calories of the tile 5, notably when said refrigeration fluid flows through the conduits 11*a* in the slab.

On the other hand, said panels 15 can power supply to the various power-consuming elements of the skating rink 1, in particular the refrigeration device 9 and sub-elements. In addition, if the power production of the panels 15 is more than the power consumption of the skating rink, said storage battery is designed to store the power remainder for future use, for example at night.

The [FIG. 2], is a schematic cross-sectional view of the slab of the skating rink 1.

Then, said slab comprises:

a first support layer 20 designed to be coated with ice 7;

a second layer 30 comprising said phase change material 13.

This embodiment is called «direct mode», because the first layer 20 directly lays on the second layer 30, which means that there is no intermediary layers between the first 20 and second 30 layers.

The second layer 30 comprises a layer of phase change material 13 with conduits 11 a of the refrigerant network 11 across it.

On the other hand, the first layer 20 is made of a material designed to be inserted between a layer of ice and the second layer 30. In addition, a thermal isolating layer 60 is advantageously set under the second layer 30 in order to thermically isolate the slab from the outside, such as the floor 70.

More specifically, the phase change material 13 is nested inside a container 100 according to the invention. The [FIG. 3] and [FIG. 4] illustrate a first embodiment of the container 100 according to the invention. More specifically, the [FIG. 3] is a lateral very schematic view and from below of a container 100, while the [FIG. 4] is a view from below of several containers 100 of the [FIG. 3] in lifting position.

Thus, said container 100 for phase change material comprises:

a closed shell 101 where a filling opening 103 is arranged;

a phase change material 13 nested inside said shell 101;

one or several recesses 105 designed to receive a conduit 11 a for refrigerant fluid.

For example, the shell 101 of said container 100 is made of a plastic, a polymer and/or a metal. Furthermore, the shell 101, where the phase change material 13 is located, is designed to contain a «gas blanket» to adapt without any notable warp the change of volume resulting from the phase change of said material 13.

More specifically, the recesses 105 designed to receive said conduits 11*a* for refrigerant fluid are grooves, which means notches at the surface of the shell 101 of said container 100.

Thus, these grooves 105 are located on only one face of said container 100 and extend, in the mode illustrated at [FIG. 3] and [FIG. 4], on the length of said container 100 and are regularly spaced (for example by a distance A) from each other. Each of these grooves 105 is designed to receive a conduit 11*a* for refrigerant fluid, wherein the insertion of a conduit 11*a* into a groove 105 is made, for example, by force fitting.

Said grooves 105 are preferably (directly) manufactured in the shell 101 by conformation, which means no matter is added or removed to create these grooves, but the shell 101 is only specially shaped during its manufacture. It notably makes it possible to retain a substantially constant thickness of the shell and to prevent hot spots and/or thermal bridges during thermal transfers between the phase change material and the refrigerant fluid.

In a first embodiment, said container 100 has substantially the shape of a plate or a tile, but could have any shape suitable to create refrigerated surfaces, for example the shape of a brick. However, it should be noted that the shape of the container according to the invention is advantageously elongated and has a main extension plane.

Thus, the tile or plate shape makes it possible to quickly assemble several containers 101 to generate a refrigerated surface, for example one of the layers that constitute the tile of an artificial skating rink.

The container according to the invention can has different shapes adapted according to its purpose, as a tile or a plate for assembly as a floor or a ceiling, as a brick for assembly as a wall or a partition.

The [FIG. 5] illustrates a second embodiment of a container 100*a* according to the invention. Thus, the identical or similar elements have the same references and won't be described anew.

Contrarily to the first embodiment, the container 100*a* has grooves 105 on both sides of the shell 101. More specifically, said grooves 105 are manufactured alternately on opposite faces of said container 100*a*. Said grooves 105 are also regularly spaced from each other.

Advantageously, the fluid through the conduits 11*a* comes from two independent refrigerant systems. This makes it possible to dose the direct thermal input, on one hand to the layers above the container 100*a*, such as the ice layer, and on the other hand to the phase change material stored in said container 100*a*.

More specifically, to store more frigories in the phase change material 13, the flow of refrigerant fluid through the conduits 11*a* under the container is preferential.

At the same time, to influence the temperature of the layers above the container (notably because of the gas blanket), they are warmed up or cooled down thanks to the conduits 11 a above the container 100*a* (then, it is possible to play on the temperature of the ice layer above the container).

The [FIG. 6] and [FIG. 7] respectively illustrate a third and a fourth embodiment of a container, respectively 100*b* and 100*c*, according to the invention. Thus, the identical or similar elements have the same references and won't be described anew.

The containers 100*b* and 100*c* comprise recesses or grooves 105 on the lateral faces of the shell (a lateral face is the thickness of said container), while extending in the main extension plane (or length) of said container 100*b* and 100*c*.

More specifically, the container 100*b* comprises grooves 105 designed to receive a part of the conduit 11*a*, while the groove of another adjacent container 100*b* receives the other part of said conduit 11*a*. Thus, the fluid conduit 11*a* is surrounded by two adjacent containers 100*b* (in contact with said containers).

Relatively to the container 100*c*, the recess 105 is configured, on one hand, to receive a conduit 11*a* and, on the other hand, to have said conduit 11*a* in contact with the conduit 11*a* of an adjacent container 100*c*.

This so that said conduits 11*a* of each container 100*c* is in contact with their respective container 100*c* and with the conduit 11*a* of the adjoining container, in order to improve the thermal transfers between the phase change material 13 and the refrigerant fluid that flows through said conduits 11*a*. Advantageously, the refrigerant fluid in the adjoining conduits 11*a* flows counter-current relatively to one another.

In a variant illustrated at the [FIG. 8] that can apply to any embodiment above, the one or several recesses 105 to receive sad conduit 11*a* have a retention angle α. A retention angle is a narrowing of the open part of the recesses or grooves 105, so that a fluid conduit 11*a* cannot easily go out of its recess and in order to improve the contact between the shell 101 of the container and the refrigerant fluid conduits 11*a*.

In another variant illustrated in the [FIG. 9] that can apply to any embodiment and variant above, the shell 101 comprises protrusions 120 on the lateral faces of the container 100*d*.

These protrusions 120 make it possible to leave some space between adjoining or assembled containers 100*d*, in order to leave concrete intrude between the containers to create an homogenous concrete slab (that entraps the containers 100*d* and the fluid conduits 11*a*).

Said container 100*d* can also comprise a reinforcement 130, more specifically illustrated at the [FIG. 10], which is made of the junction of the walls of the opposite faces of the shell 101 of the container 100*d*. Such a reinforcement makes notably possible to rigidify the container.

Said reinforcement 130 is advantageously located at the center of the container 100*d*, on one hand, and is fitting inside said shell 101, on the other hand. This reinforcement 130 can also be applied (or integrated) to any of the embodiments and variants of the container above.

Said reinforcement 130 has substantially the shape of a double cone, wherein said cones are linked together at their tip, with the respective base of each of said cones on one of the faces of said container 100*d* (more clearly visible at the FIG. 10).

The [FIG. 11] and [FIG. 12] illustrate a fifth embodiment of a container 100*e* according to the invention, wherein said FIGS. 11 and 12 are perspective schematic views of said container 100*e*, respectively from above and from below. Thus, the identical or similar elements have the same references and won't be described anew.

Said container 100*e* comprises, like the other embodiments and variants described above, a shell 101, a filling opening 103, recesses 105 where may be set conduits 11*a*, protrusions 120, etc.

However, said container 100*e* comprises recesses or nooks 108, advantageously on the upper face of the container 100*e*. The upper face is the face turned toward the ice layer 7, and on which are lain one or several intermediary materials between the container 100*e* and the layer 7, such as concrete.

The reinforcements 108 are advantageously plane surfaces 108*a*, so that the intermediary material can best conform to the shape of the container 100*e*, thus optimize the thermal exchange surfaces between the container 100*e* and the ice layer 7 through said intermediary material.

Each reinforcement 108 is separated from the other ones by one or several protrusions 110. Said protrusions 110 notably make it possible to maintain and minimize the volume of the gas blanket in the phase change material 13, since the phase change material does not fill the upper part of said protrusions 110. The reinforcements 108 and the protrusions 110 show advantageously an embossed pattern, i.e. an alternance of recesses and protrusions.

Said container 100*e* also comprises, on one of its faces, preferably on the lower face of the container 100*e*, one or several deformable structures 112, advantageously comprising a bellow 112*a* (it is also possible to talk of an accordion shape for the bellow 112*a*).

These deformable structures make it possible to the container 100*e* to warp when there is a change of the physical state of the state change material 13, notably when it passes from a liquid state to a solid state (and when there is an increase of its volume).

It should be noted that the lower face is the face opposite to the ice layer 7 (and to the upper face of the container). More specifically, the deformable structures 112 have a plane surface 112*b* set back from the surface of the shell or the terminal surface of the container 100*e*, more specifically from the lower face. Thus, the bellows 112*a* link at least partially the plane surface 112*b* to the terminal surface of the container 100*e*.

Thus, a plane surface 112*b* set back from the terminal surface of the container 100*e* is configured to move, thanks to the bellows 112*a*, under the action of an increase of volume of the phase change material inside the container 100*e*, notably toward the terminal surface (or the shell of the container). However, the bellows 112*a* are configured, so that the plane surface 112*b* cannot protrude from the terminal surface of the container 100*e*.

Moreover, the volume between the plane surface 112*b* and the terminal surface of the container is advantageously filled with a (not illustrated) low density foam, such as a closed cell low density foam. Thus, when installing the container 100*e*, the volume of the foam does not fill with various materials, such as concrete, sand, etc., which allows the deformable structure 112 to warp by compressing the foam, although said container 100*e* is entrapped between various layers of materials, such as the first layer 20 and the thermal isolating layer 60.

Thus, the deformable structures 112 prevent the total congestion of the container 100*e* from varying when the phase change material 13 it contains changes of physical state (by volume increase), wherein a change of congestion may have dramatic consequences to the layers on the container 100*e*, notably on the ice layer 7.

It shall also be noted that the recesses 108 and/or the deformable structures 112 can apply to any embodiment or variant previously described.

Furthermore, it shall also be noted that the refrigeration device 9 is configured to have at least two operating modes:

a first operating mode, called «day mode», where the excess calories are stored and/or removed into the phase change material 13 and/or by the heat exchangers of said refrigeration device;

a second operating mode, called «night mode», where the air above the slab is best cooled thanks to the air-conditioning system, and where the frigories in the phase change material make it possible to keep the ice on said slab at a temperature less than its melting temperature.

In the second operating mode, the at least one pump and compressor of said refrigeration device 9 are stopped to minimize the power consumption of the skating rink.

Thus, the night mode makes it possible to store frigories in the phase change material, which can be used later, for example in the day, when people skate on the slab and it is not possible to cool enough air above the surface to skate.

Said working modes of said device 9 can also apply to a cold room, where partitions, the floor or the ceiling comprise or are made of an assembly of containers according to the invention, wherein this assembly creates a refrigerated surface.

What is claimed is:

1. A plurality of containers for a phase change material, comprising:

a first container comprising:

a closed shell comprising a filling opening, a top side, a bottom side, a first lateral side and a second lateral side;

a phase change material nested inside said closed shell;

wherein a side of the closed shell comprises a first group of one or several conduit recesses having a concave curved surface designed to receive a conduit for refrigerant fluid, the one or several conduit recesses extending from the first lateral side to the second lateral side.

2. The plurality of containers according to claim 1, wherein the closed shell comprises several reception recesses which are shaped directly in the shell of said top side of the first container, wherein a first conduit recess of the one or several conduit recesses is disposed between a first group of the several reception recesses and a second group of the several reception recesses.

3. The plurality of containers according to claim 1, a second container comprising:

a closed shell comprising a filling opening, a top side, a bottom side, a first lateral side and a second lateral side; and a phase change material nested inside said closed shell of the second container, wherein a side of the second container comprises a first group of one or several conduit recesses designed to receive the conduit for refrigerant fluid, the one or several conduit recesses of the second container extending from the first lateral side to the second lateral side of the second container; and wherein when the first container is positioned horizontally to the second container, the one or several conduit recesses of the first container mate with the one or several conduit recesses of the second container such that a single conduit for refrigerant fluid is seated in both a conduit recess of the first container and an adjacent mated conduit recess of the second container.

4. The plurality of containers according to claim 2, wherein the first container has substantially the shape of a plate, a tile or a brick.

5. The plurality of containers according to claim 2, characterized in wherein said one or several recesses are grooves manufactured at the surface of said first container.

6. The plurality of containers according to claim 5, wherein said grooves are regularly spaced on said container.

7. The plurality of containers according to claim 5, wherein said grooves are located on opposite faces of said first container.

8. The plurality of containers according to claim 2, wherein the one or several reception recesses have a retention angle a.

9. The plurality of containers according to claim 2, that wherein the first container has an embossed aspect on at least one of its faces.

10. The plurality of containers according to claim 2, wherein the first container comprises an alternation of recesses and embossed patterns on at least one of its faces.

11. The plurality of containers according to claim 2, wherein the first container comprises deformable structures on at least one of the container's faces, which are designed to warp under the effect of a change of state of the phase change material.

12. The plurality of containers according to claim 11, wherein the deformable structures comprise at least one bellow and/or a low density foam.

13. The plurality of containers according to claim 12, wherein the deformable structures comprise at least one plane surface recessed from the terminal surface of the first container, wherein said at least one bellow is designed to allow the movement of the plane surface toward the terminal surface until a limit that corresponds to the terminal surface of said first container.

14. The first container according to claim 2, wherein a second conduit recess of the one or several conduit recesses is disposed on the top side between the second group of the several reception recesses and a third group of the several reception recesses.

15. The first container according to claim 1, wherein the bottom side comprises a second group of one or several conduit recesses designed to receive another conduit for refrigerant fluid, the one or several recesses extending from the first lateral side to the second lateral side.

16. The container according to claim 1, wherein the closed shell comprises multiple protrusions disposed on the top side, wherein each protrusion of the multiple protrusions is positioned between an adjacent reception recess.

17. The container according to claim 1, wherein the closed shell comprises four lateral sides, including the first lateral side and the second lateral side, and wherein one two or more sides comprise a plurality of extending protrusions.

18. A plurality of containers for a phase change material, comprising:

a first container comprising:

a closed shell comprising a filling opening, a top side, a bottom side, a first lateral side and a second lateral side, wherein the closed shell of the first container is configured to hold a phase change material nested inside said closed shell of the first container, and wherein the first container comprises a first group of one or several conduit recesses designed to receive a conduit for refrigerant fluid, the one or several conduit recesses extending from the first lateral side to the second lateral side; and a second container comprising:

a closed shell comprising a filling opening, a top side, a bottom side, a first lateral side and a second lateral side, wherein the closed shell of the second container is configured to hold a phase change material nested inside said closed shell of the second container, and wherein the second container comprises a first group of one or several conduit recesses designed to receive a conduit for refrigerant fluid, the one or several conduit recesses of the second container extending from the first lateral side to the second lateral side of the second container; and wherein when the first container is positioned horizontally to the second container, the one or several conduit recesses of the first container mate with the one or several conduit recesses of the second container such that a single conduit is seated in both a conduit recess of the first container and an adjacent mated conduit recess of the second container; and wherein each of the one or several conduit recesses of both the first container and the second container have a concave curved surface to receive the conduit for refrigerant fluid.

19. The plurality of containers according to claim 18, wherein the closed shell of the first container comprises several reception recesses which are shaped directly in the shell of said top side, wherein a first conduit recess of the one or several conduit recesses is disposed between a first group of the several reception recesses and a second group of the several reception recesses.

* * * * *